US011640799B2

(12) United States Patent
Lim

(10) Patent No.: US 11,640,799 B2
(45) Date of Patent: May 2, 2023

(54) DISPLAY APPARATUS

(71) Applicant: Samsung Display Co., LTD., Yongin-si (KR)

(72) Inventor: Sanghyun Lim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/898,327

(22) Filed: Aug. 29, 2022

(65) Prior Publication Data

US 2022/0415267 A1 Dec. 29, 2022

Related U.S. Application Data

(63) Continuation of application No. 17/209,250, filed on Mar. 23, 2021, now Pat. No. 11,430,393.

(30) Foreign Application Priority Data

Aug. 3, 2020 (KR) ..... 10-2020-0096944

(51) Int. Cl.
*G09G 3/3291* (2016.01)
*G09G 3/3233* (2016.01)
*G09G 3/3266* (2016.01)

(52) U.S. Cl.
CPC ..... *G09G 3/3291* (2013.01); *G09G 3/3233* (2013.01); *G09G 3/3266* (2013.01);
(Continued)

(58) Field of Classification Search
CPC .. G09G 3/3291; G09G 3/3233; G09G 3/3266; G09G 2300/0452;
(Continued)

(56) References Cited

U.S. PATENT DOCUMENTS 10,354,582 B2 7/2019 Kim
10,431,179 B2 10/2019 Hao
(Continued)

FOREIGN PATENT DOCUMENTS

KR 10-2019-0071365 6/2019
KR 10-2020-0007318 1/2020
KR 10-2020-0034477 3/2020

OTHER PUBLICATIONS

Non-Final Office Action dated Oct. 25, 2021, in U.S. Appl. No. 17/209,250.
(Continued)

*Primary Examiner* — Kenneth B Lee, Jr.
(74) *Attorney, Agent, or Firm* — H.C. Park & Associates, PLC

(57) ABSTRACT

A display apparatus includes a pixel portion in which a plurality of pixels are arranged, the plurality of pixels being connected to scan lines and data lines; a data driver configured to transmit a data signal to a source output line; a data distributer configured to selectively connect the source output line to the data lines; and a latch portion arranged between the data distributer and the pixel portion, wherein the latch portion includes a plurality of latches connected to at least one of data lines excluding a data line, from among the data lines, connected to the source output line by the data distributer at a timing at which a scan signal is transmitted to the scan lines.

20 Claims, 17 Drawing Sheets

(52) U.S. Cl.
CPC ..... *G09G 2300/0452* (2013.01); *G09G 2310/0291* (2013.01); *G09G 2310/0297* (2013.01); *G09G 2310/08* (2013.01)

(58) Field of Classification Search
CPC ... G09G 2310/0291; G09G 2310/0297; G09G 2310/08
See application file for complete search history.

(56) References Cited

U.S. PATENT DOCUMENTS

| | | | | |
|---|---|---|---|---|
| 10,586,498 | B2 | 3/2020 | Ryu | |
| 2004/0178849 | A1* | 9/2004 | Kimura | G11C 27/024 330/253 |
| 2020/0020296 | A1* | 1/2020 | Kim | G09G 3/3696 |

OTHER PUBLICATIONS

Notice of Allowance dated Apr. 27, 2022, in U.S. Appl. No. 17/209,250.

* cited by examiner

DISPLAY APPARATUS

CROSS-REFERENCE TO RELATED APPLICATION

This application is a continuation of U.S. patent application Ser. No. 17/209,250, filed on Mar. 23, 2021, which claims priority from and the benefit of Korean Patent Application No. 10-2020-0096944, filed on Aug. 3, 2020, each of which is hereby incorporated by reference for all purposes as if fully set forth herein.

BACKGROUND

Field

Exemplary embodiments and implementations of the invention relate generally to a display apparatus and a driving method thereof.

Discussion of the Background

A display apparatus includes a plurality of scan lines, a plurality of data lines, and a plurality of pixels arranged at intersections thereof. To apply a data signal to each of the plurality of data lines, a data driver needs to include the same number of output lines as the number of data lines and a plurality of integrated circuits are required and accordingly, the manufacturing costs increase.

The above information disclosed in this Background section is only for understanding of the background of the inventive concepts, and, therefore, it may contain information that does not constitute prior art.

SUMMARY

One or more embodiments include a display apparatus having a reduced number of output lines of a data driver and a driving of the display apparatus. One or more embodiments include a display apparatus and a driving method thereof, which may reduce image quality deterioration due to introduction of external noise to a data line. However, such a technical problem is an example, and the disclosure is not limited thereto.

Additional aspects will be set forth in part in the description which follows and, in part, will be apparent from the description, or may be learned by practice of the presented embodiments of the disclosure.

According to one or more embodiments, a display apparatus includes a pixel portion in which a plurality of pixels are arranged, the plurality of pixels being connected to scan lines and data lines, a data driver configured to transmit a data signal to a source output line, a data distributer configured to selectively connect the source output line to the data lines, and a latch portion arranged between the data distributer and the pixel portion, wherein the latch portion includes a plurality of latches connected to at least one of data lines, from among the data lines, excluding a data line connected to the source output line by the data distributer at a timing at which a scan signal is transmitted to the scan lines.

Each of the plurality of latches may include an amplifier including an input terminal connected to the source output line and an output terminal connected to a corresponding data line from among the data lines, and a capacitor connected between the input terminal and a power portion.

The power portion may apply a first power voltage and a second power voltage to each of the plurality of pixels.

A first input terminal of the amplifier may be connected to the source output line, and a second input terminal of the amplifier may be connected to the output terminal.

The latch may further include a first resistor between the second input terminal of the amplifier and the power portion, and a second resistor between the second input terminal and the output terminal.

The latch portion may further include a first transistor connected between the first input terminal and the output terminal of the amplifier.

The first transistor may be turned on at a timing at which the corresponding data line is connected to the source output line.

The latch portion may further include a second transistor connected between the first input terminal of the amplifier and the source output line.

The first transistor may be turned on at a timing at which the corresponding data line is connected to the source output line, and the second transistor may be turned on at a timing at which a scan signal is transmitted to the scan lines.

The pixels may include red pixels, blue pixels, and green pixels, the red pixels being connected to a first data line on a first column, the blue pixels being connected to a second data line on a second column, and the green pixels being connected to a third data line on a third column, and the latch portion may include a first latch and a second latch, the first latch being connected to the first data line, and the second latch being connected to the second data line.

The pixels may include red pixels, blue pixels, and green pixels, the red pixels being connected to a first data line on a first column, the blue pixels being connected to a second data line on a second column, and the green pixels being connected to a third data line on a third column, and the latch portion may include a latch connected to the first data line.

The data distributer may include a plurality of switches, and each of the plurality of switches may be connected between a corresponding data line from among the data lines and the source output line.

According to one or more embodiments, a display apparatus includes a plurality of pixels connected to scan lines and data lines, a source output line to which a data signal is transmitted, a demultiplexer including a plurality of switches connected to the source output line and the data lines, and a plurality of latches connected between switches turned off at a timing at which a scan signal is transmitted to the scan lines, from among the plurality of switches and the data lines.

Each of the plurality of latches may include an amplifier including an input terminal connected to the source output line and an output terminal connected to a corresponding data line from among the data lines, and a capacitor connected between the input terminal and a power portion, and the power portion may apply a first power voltage and a second power voltage to each of the plurality of pixels.

A first input terminal of the amplifier may be connected to the source output line, and a second input terminal of the amplifier may be connected to the output terminal.

The latch may further include a first resistor between the second input terminal of the amplifier and the power portion, and a second resistor between the second input terminal and the output terminal.

The latch portion may further include a first transistor connected between the input terminal and the output terminal of the amplifier.

The first transistor may be turned on at a timing at which the corresponding data line is connected to the source output line.

The latch portion may further include a second transistor connected between the first input terminal of the amplifier and the source output line.

The first transistor may be turned on at a timing at which the corresponding data line is connected to the source output line, and the second transistor may be turned on at a timing at which a scan signal is transmitted to the scan lines.

It is to be understood that both the foregoing general description and the following detailed description are exemplary and explanatory and are intended to provide further explanation of the invention as claimed.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
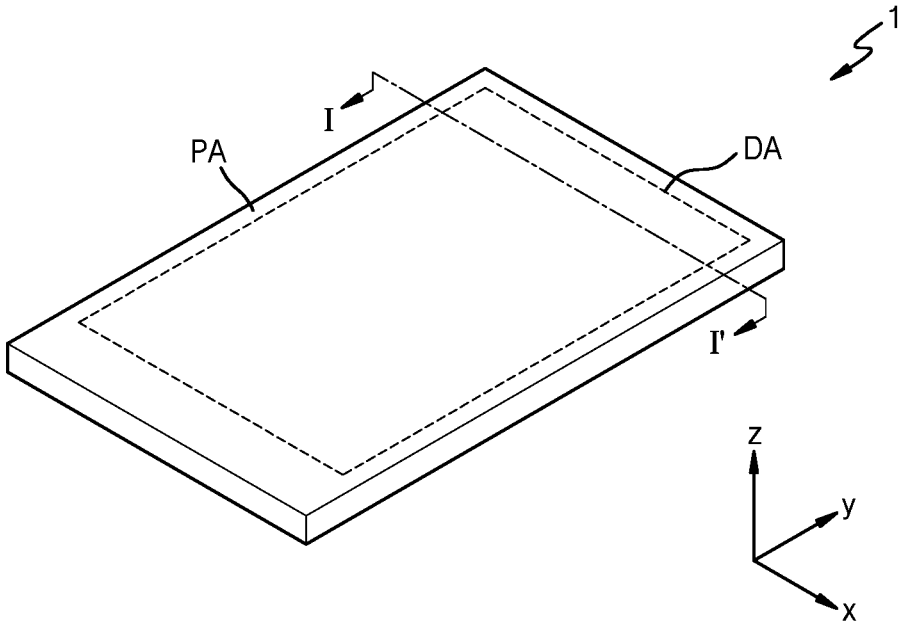
FIG. 1 is a perspective view illustrating a display apparatus according to an embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are illustrated in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Throughout the disclosure, the expression "at least one of a, b or c" indicates only a, only b, only c, both a and b, both a and c, both b and c, all of a, b, and c, or variations thereof.

As the present description allows for various changes and numerous embodiments, certain embodiments will be illustrated in the drawings and described in the written description. Effects and features of one or more embodiments and methods of accomplishing the same will become apparent from the following detailed description of the one or more embodiments, taken in conjunction with the accompanying drawings. However, the present embodiments may have different forms and should not be construed as being limited to the descriptions set forth herein.

While such terms as "first" and "second" may be used to describe various elements, such elements may not be limited to the above terms. The above terms are used to distinguish one element from another.

The singular forms "a," "an," and "the" as used herein are intended to include the plural forms as well unless the context clearly indicates otherwise.

It will be understood that the terms "comprise," "comprising," "include" and/or "including" as used herein specify the presence of stated features or elements but do not preclude the addition of one or more other features or elements.

It will be further understood that, when a layer, region, or element is referred to as being "on" another layer, region, or element, it can be directly or indirectly on the other layer, region, or element. That is, for example, intervening layers, regions, or elements may be present.

Sizes of elements in the drawings may be exaggerated or reduced for convenience of explanation. In other words, because sizes and thicknesses of elements in the drawings are is arbitrarily illustrated for convenience of explanation, the following embodiments are not limited thereto.

In the disclosure, "A and/or B" may include "A," "B," or "A and B." In addition, in the inventive concepts, "at least one of A and B" may include "A," "B," or "A and B."

As used herein, when a wiring is referred to as "extending in a first direction or a second direction", it means that the wiring not only extends in a straight line shape but also extends in a zigzag or in a curve in the first direction or the second direction.

In the following disclosure, a "plan view" indicates that a portion of a target object is seen from above, and a "cross-sectional view" indicates that a portion of a target object is vertically cut and the cross-section is viewed from the side. As used herein, when it is referred that a first element "overlaps" a second element, the first element is arranged above or below the second element.

As used herein, when it is referred that X and Y are connected, it may include the case where X and Y are electrically connected, the case where X and Y are functionally connected, and the case where X and Y are directly connected. Here, X and Y may include objects (e.g. apparatuses, devices, circuits, wirings, electrodes, terminals, conductive layers, layers, etc.) Therefore, connection is not limited to preset connection relationship, for example, not limited to connection relationship illustrated in the drawings or detailed descriptions, and may include other connections relationships not illustrated in the drawings or detailed descriptions.

The case where X and Y are electrically connected may include, for example, the case where at least one device (e.g. a switch, a transistor, a capacitance element, an inductor, a resistance element, a diode, etc.) that enables electrical connection of X and Y is connected between X and Y.

As used herein, "ON" used in association with an element state may denote an activated state of an element, and "OFF" may denote an inactivated state of an element. "ON" used in association with a signal received by an element may denote a signal activating the element, and "OFF" may denote a signal inactivating the element. An element may be activated by a high-level voltage or a low-level voltage. As an example, a P-channel transistor is activated by a low-level voltage, and an N-channel transistor is activated by a high-level voltage. Therefore, it should be understood that "ON" voltages for a P-channel transistor and an N-channel transistor are opposite (high versus low) voltage levels.

Figure 2:
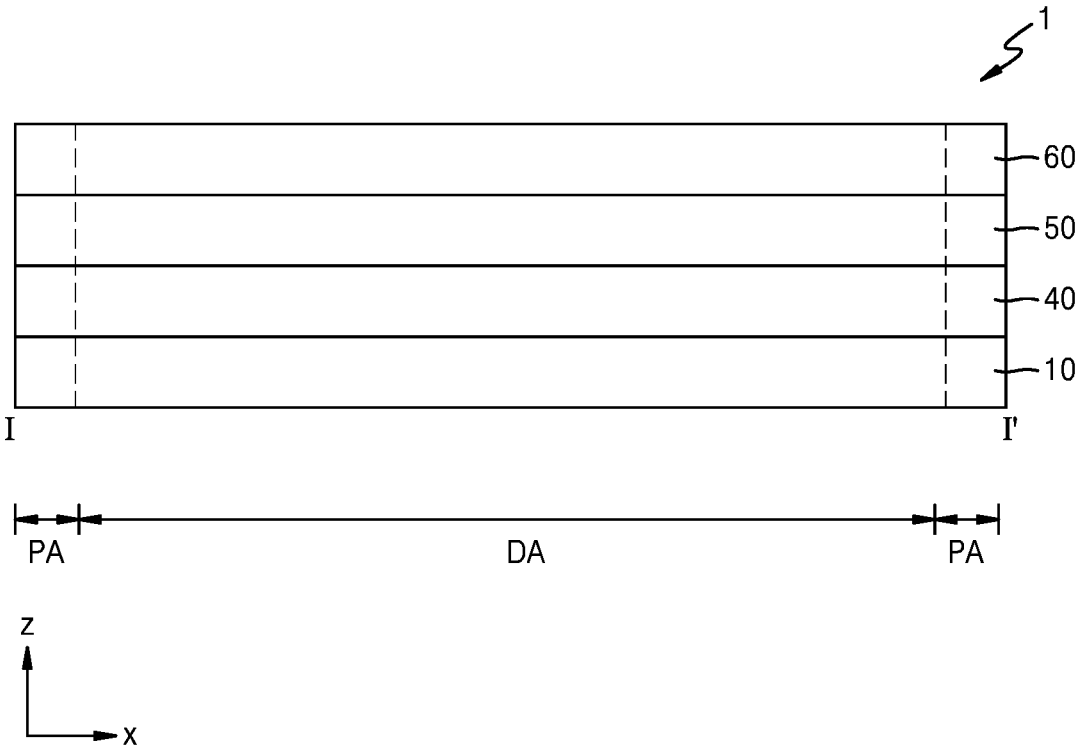
FIG. 2 is a cross-sectional view illustrating a display apparatus according to an embodiment.

FIG. 1 is a perspective view illustrating a display apparatus 1 according to an embodiment. FIG. 2 is a cross-sectional view illustrating the display apparatus 1 according to an embodiment, taken along line I-I' of FIG. 1.

The display apparatus 1 according to embodiments may be implemented as electronic apparatuses including smartphones, mobile phones, smartwatches, navigation apparatuses, game consoles, televisions (TV), head units for automobiles, notebook computers, laptop computers, tablet computers, personal media players (PMP), and personal digital assistants (PDA). In addition, the electronic apparatuses may include flexible apparatuses.

The display apparatus 1 may include a display area DA and a peripheral area PA, an image being displayed in the display area DA, and the peripheral area PA being outside the display area DA. The display apparatus 1 may display an image by using light emitted from a plurality of pixels arranged in the display area DA.

The display apparatus 1 may be prepared in various shapes and, for example, prepared in a rectangular plate shape having two pairs of sides parallel to each other. In the case where the display apparatus is prepared in a rectangular plate shape, one pair of sides among two pairs of sides may be longer than the other pair of sides. In an embodiment, for convenience of description, description is made to the case where the display apparatus has a rectangular shape having a pair of long sides and a pair of short sides. An extension direction of a short side is denoted by a first direction (an x-direction), an extension direction of a long side is denoted by a second direction (a y-direction), and a direction perpendicular to the extension directions of the long side and the short side is denoted by a third direction (a z-direction). In another embodiment, the display apparatus 1 may have a non-quadrangular shape. A non-quadrangular shape may include, for example, circular shapes, elliptical shapes, polygons in which a portion thereof is circular, and polygons excluding quadrangles.

In a plan view, the display area DA may have a rectangular shape as illustrated in FIG. 1. In another embodiment, the display area DA may have polygonal shapes such as triangles, pentagons, and hexagons, circular shapes, elliptical shapes, or irregular shapes.

The peripheral area PA is a region outside the display area DA and may be a kind of non-display area in which pixels are not arranged. The display area DA may be entirely surrounded by the peripheral area PA. Various wirings, or pads may be arranged in the peripheral area PA, the various wirings transferring an electric signal to be applied to the display area DA, and a printed circuit board and a driver integrated circuit (IC) chip being attached on the pads.

Hereinafter, though an organic light-emitting display apparatus is described as the display apparatus 1 according to an embodiment as an example, the embodiment is not limited thereto. In another embodiment, the display apparatus 1 according to an embodiment may include inorganic light-emitting displays and quantum-dot light-emitting displays.

Referring to FIG. 2, the display apparatus 1 may include a display panel 10, an input sensing layer 40, and an optical functional layer 50, the input sensing layer 40 being on the display panel 10. These elements may be covered by a window 60.

The display panel 10 may display an image. The display panel 10 includes pixels arranged in the display area DA. Each pixel may include a display element. The display element may be connected to a pixel circuit. The display element may include an organic light-emitting diode or a quantum-dot organic light-emitting diode.

The input sensing layer 40 obtains coordinate information corresponding to an external input, for example, a touch event. The input sensing layer 40 may include a sensing electrode (or a touch electrode) and a trace lines connected to the sensing electrode. The input sensing layer 40 may be arranged on the display panel 10. The input sensing layer 40 may sense an external input by using a mutual capacitive method and/or a self-capacitive method.

The input sensing layer 40 may be directly formed on the display panel 10 or be coupled to the display panel 10 through an adhesive layer such as an optical clear adhesive. As an example, the input sensing layer 40 may be successively formed after a process of forming the display panel 10. In this case, the input sensing layer 40 may be a portion of the display panel 10, and an adhesive layer may not be arranged between the input sensing layer 40 and the display panel 10. Though it is illustrated in FIG. 2 that the input sensing layer 40 is arranged between the display panel 10 and the optical functional layer 50, the input sensing layer 40 may be arranged on the optical functional layer 50 in another embodiment.

The optical functional layer 50 may include an anti-reflection layer. The anti-reflection layer may reduce reflectivity of light (external light) incident toward the display panel 10 from the outside through the window 60. The anti-reflection layer may include a retarder and a polarizer. The retarder may be of a film type or a liquid crystal coating type, and may include a $\lambda/2$ retarder and/or a $\lambda/4$ retarder. The polarizer may also be a film type or a liquid crystal coating type. The film type may include a stretched synthetic resin film, and the liquid crystal coating type may include liquid crystals arranged in a certain arrangement. The retarder and polarizer may each further include a protective film. The retarder and polarizer themselves or the protective film of the retarder and the polarizer may be defined as a base layer of the anti-reflection layer.

In another embodiment, the anti-reflection layer may include a black matrix and color filters. The color filters may be arranged by taking into account colors of light emitted respectively from the pixels of the display panel 10. In another embodiment, the anti-reflection layer may include a destructive interference structure. The destructive interference structure may include a first reflection layer and a second reflection layer respectively arranged on different layers. First-reflected light and second-reflected light respectively reflected by the first reflection layer and the second reflection layer may create destructive-interference and thus the reflectivity of external light may be reduced.

The optical functional layer 50 may include a lens layer. The lens layer may improve emission efficiency of light emitted from the display panel 10 or reduce color deviation. The lens layer may include a layer having a concave or convex lens shape and/or include a plurality of layers having different refractive indexes. The optical functional layer 50 may include both the anti-reflection layer and the lens layer, or include one of these layers.

In an embodiment, the optical functional layer 50 may be successively formed after a process of forming the display panel 10 and/or the input sensing layer 40. In this case, an adhesive layer may not be arranged between the optical functional layer 50 and the display panel is 10 and/or the input sensing layer 40.

Figure 3:
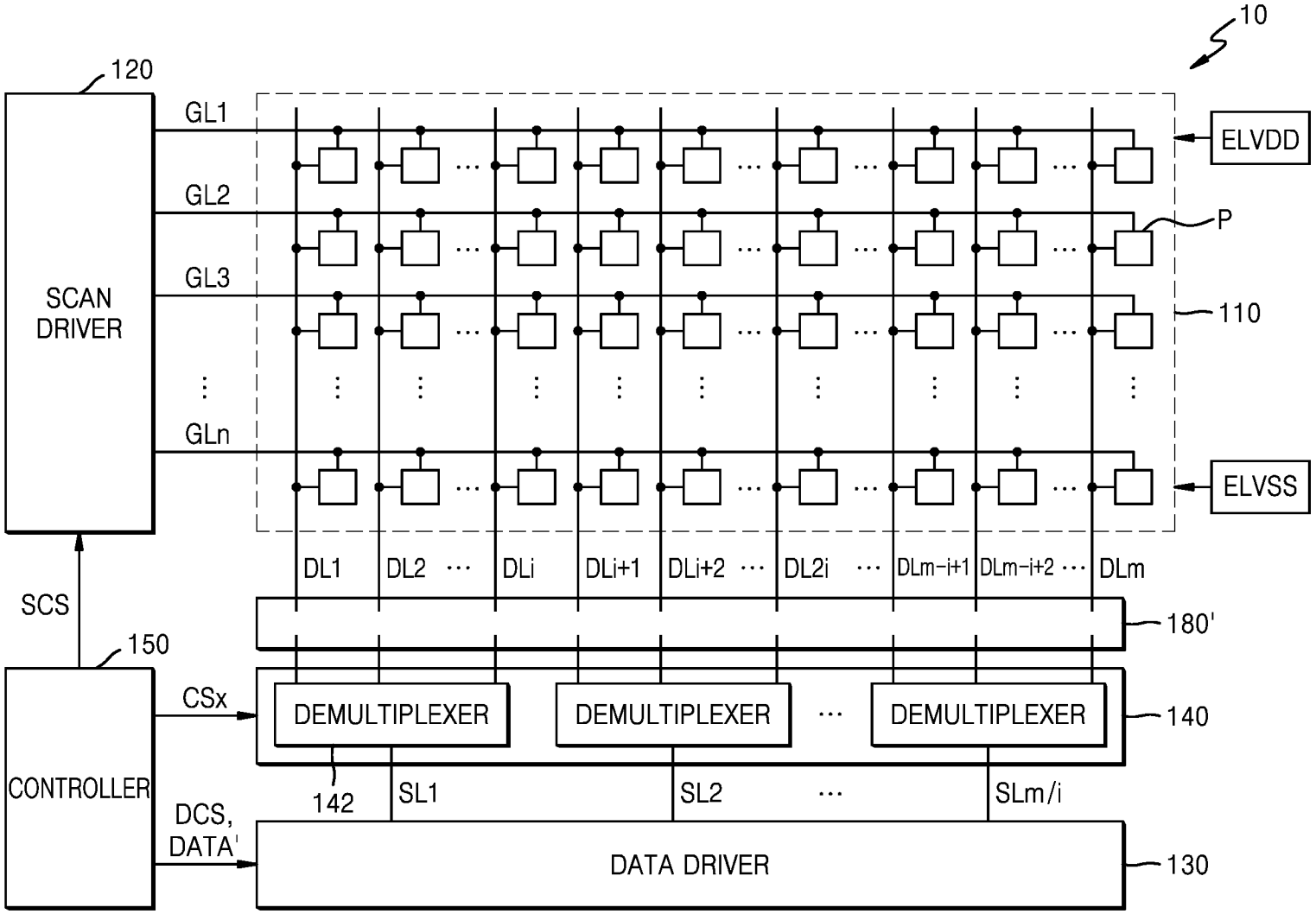
FIG. 3 is a plan view illustrating a display panel according to an embodiment.

FIG. 3 is a plan view illustrating the display panel 10 according to an embodiment.

Referring to FIG. 3, various kinds of elements constituting the display panel 10 are arranged over a substrate. That is, the substrate may include the display area DA corresponding to the display area DA and the peripheral area PA of the display panel 10, and the peripheral area PA surrounding the display area DA.

A pixel portion 110 in which a plurality of pixels P are arranged may be arranged in the display area DA. A scan driver 120, a data driver 130, a data distributer 140, and a controller 150 may be arranged in the peripheral area PA.

Each of the plurality of pixels P may be connected to a corresponding scan line among a plurality of scan lines GL1, GL2, . . . , and GLn, and a corresponding data line among a plurality of data lines DL1, DL2, . . . , and DLm. The plurality of scan lines GL1, GL2, . . . , and GLn are arranged in rows and apart from each other at a constant interval to transfer respective scan signals. The plurality of data lines DL1, DL2, . . . , and DLm are arranged in columns and apart from each other at a constant interval to transfer respective data signals. The plurality of scan lines GL1, GL2, . . . , and GLn and the plurality of data lines DL1, DL2, . . . , and DLm are arranged in a matrix configuration. In this case, a pixel P may be formed at an intersection portion of a scan line GLx and a date line DLx. A driving voltage ELVDD, which is a first power voltage, and a common voltage ELVSS, which is a second power voltage, may be transferred from a power portion to the pixels P of the pixel portion 110. The power portion may be provided in the peripheral area PA.

The scan driver 120 is connected to the plurality of scan lines GL1, GL2, . . . , and GLn, generates respective scan signals according to a scan driving control signal SCS input from the controller 150, and supplies respective generated scan signals to the plurality of scan lines GL1, GL2, . . . , and GLn. In an embodiment, the scan driver 120 may include a plurality of stage circuits and sequentially supply scan signals to the plurality of scan lines GL1, GL2, . . . , and GLn. When scan signals are sequentially supplied to the plurality of scan lines GL1, GL2, and GLn, the pixels P may be selected on a row basis.

The data driver 130 is connected to a plurality of source output lines SL1, SL2, . . . , and SLm/i, which are connected to the plurality of data lines DL1, DL2, . . . , and DLm through the data distributer 140. The data driver 130 converts an image signal DATA' to a data signal in the form of a voltage or a current according to a data driving control signal DCS input from the controller 150. The data driver 130 supplies respective data signals to the data distributer 140 through the source output lines SL1, SL2, . . . , and SLm/i.

The data distributer 140 is connected on one side to the plurality of source output lines SL1, SL2, . . . , and SLm/i, and on another side to the plurality of data lines DL1, DL2, and DLm. The data distributer 140 may include mui (i is a natural number equal to or greater than 2) demultiplexers 142 that include a plurality of switching elements. The data distributer 140 includes the same number of demultiplexers as the number of source output lines. One end of each demultiplexer 142 is connected to one corresponding source output line among the plurality of source output lines SL1, SL2, . . . , and SLm/i. In addition, the other end of each demultiplexer 142 is connected to i data lines. The demultiplexer 142 supplies a data signal supplied from one source output line to i data lines. When the demultiplexer 142 is used, the number of source output lines less than the number of data lines is used. Accordingly, the number of source output lines connected to the data driver 130 is reduced and thus manufacturing costs may be reduced. The demultiplexer 142 may include a plurality of switches connected to a corresponding source output line and each of i data lines.

A latch portion 180' may be arranged between the data distributer 140 and the pixel portion 110. The latch portion 180' may include a plurality of sub-latch portions respectively corresponding to the demultiplexers 142. That is, the number of the demultiplexers 142 may be the same as the number of sub-latch portions. Each of the sub-latch portions may include a plurality of latches connected to data lines excluding a data line connected to a corresponding source output line at a timing at which a scan signal is applied through scan lines among data lines connected to a corresponding demultiplexer 142. There may be a case where the demultiplexer 142 selectively connects i data lines with respect to one source output line. As such, a sub-latch portion may be connected to at least one of the data lines excluding a data line connected to a source output line at a timing at which a scan signal is applied through scan lines among i data lines. As an example, the sub-latch portion may include at least one latch to (i-1) latches.

The controller 150 generates a data driving control signal DCS and a scan driving control signal SCS based on synchronization signals supplied from the outside. The controller 150 outputs a data driving control signal DCS to the data driver 130 and outputs a scan driving control signal SCS to the scan driver 120. The controller 150 may output a demux control signal CSx to the data distributer 140, which may selectively connect the source output lines SL1, SL2, . . . , and SLm/i to the data lines DL1, DL2, . . . , and DLm according to a demux control signal CSx. The controller 150 may output i demux control signals CSx to the demultiplexers 142 such that i data signals supplied to one source output line are supplied by time division to i data lines. i control signals may be sequentially output not to overlap each other.

The scan driver 120, the data distributer 140, and the controller 150 may be directly formed on the substrate. The data driver 130 may be arranged on a flexible printed circuit board (FPCB) electrically connected to a pad on one side of the substrate. In another embodiment, the data driver 130 may be directly arranged on the substrate through a chip-on-glass method or a chip-on-plastic method.

Figure 4A:
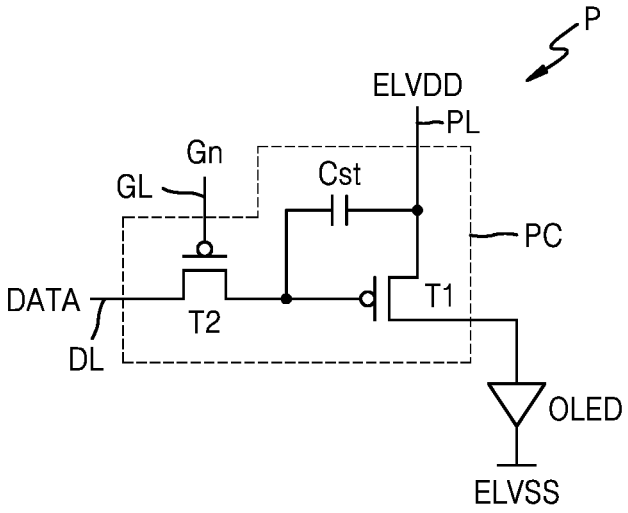
FIGS. 4A and 4B are equivalent circuit diagrams illustrating a pixel according to an embodiment.
Figure 4B:
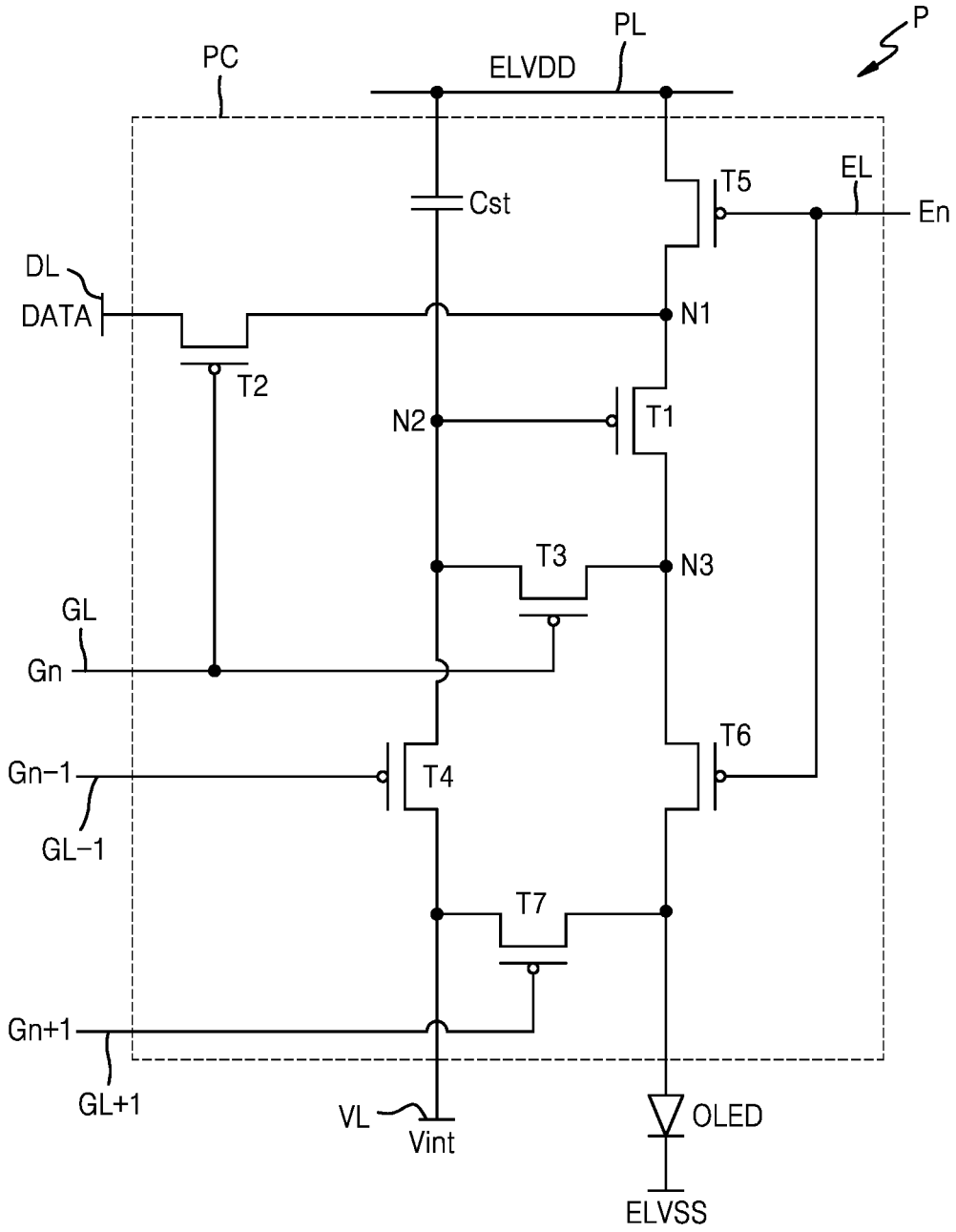

FIGS. 4A and 4B are equivalent circuit diagrams illustrating a pixel according to an embodiment.

Referring to FIG. 4A, a pixel circuit PC may be connected to a light-emitting element to implement light emission of a pixel P. The light-emitting element may include an organic light-emitting diode OLED. The pixel circuit PC includes a driving transistor T1, a switching transistor T2, and a capacitor Cst. The switching transistor T2 is connected to a scan line GL and a data line DL and transfers a data signal DATA input through the data line DL to the driving transistor T1 according to a scan signal Gn input through the scan line GL.

The capacitor Cst is connected to the switching transistor T2 and a driving voltage line PL and stores a voltage corresponding to a difference between a voltage transferred from the switching transistor T2 and the driving voltage ELVDD supplied to the driving voltage line PL.

The driving transistor T1 is connected to the driving voltage line PL and the capacitor Cst and may control a driving current flowing to an organic light-emitting diode OLED from the driving voltage line PL according to the voltage stored in the capacitor Cst. The organic light-emitting diode OLED may emit light having a certain luminance according to the driving current.

Though FIG. 4A illustrates a case where the pixel circuit PC includes two thin film transistors and one capacitor, the embodiment is not limited thereto.

Referring to FIG. 4B, a pixel circuit PC may include first to seventh transistors T1, T2, T3, T4, T5, T6, and T7, and a first terminal of each of first to seventh transistors T1, T2, T3, T4, T5, T6, and T7 may be a source terminal or a drain terminal and a second terminal may be a terminal different from the first terminal depending on the kind (a p-type or an n-type) of a transistor and/or an operational condition. As an example, in the case where the first terminal is a source terminal, the second terminal may be a drain terminal.

The pixel circuit PC may be connected to a first scan line GL, a second scan line GL−1, a third scan line GL+1, an emission control line EL, the data line DL, the driving voltage line PL, and an initialization voltage line VL, the first scan line GL transferring a first scan signal Gn, the second scan line GL−1 transferring a second scan signal Gn−1, the third scan line GL+1 transferring a third scan signal Gn+1, the emission control line EL transferring an emission control signal En, the data line DL transferring a data signal DATA, the driving voltage line PL transferring the driving voltage ELVDD, and the initialization voltage line VL transferring an initialization voltage Vint.

The first transistor T1 includes a gate terminal, a first terminal, and a second terminal, the gate terminal being connected to a second node N2, the first terminal being connected to a first node N1, and the second terminal being connected to a third node N3. The first transistor T1 serves as a driving transistor, receives a data signal DATA according to a switching operation of the second transistor T2, and supplies the driving current to the light-emitting element. The light-emitting element may include an organic light-emitting diode OLED.

The second transistor T2 (a switching transistor) includes a gate terminal, a first terminal, and a second terminal, the gate terminal being connected to the first scan line GL, the first terminal being connected to the data line DL, and the second terminal being connected to the first node N1 (or the first terminal of the first transistor T1). The second transistor T2 may be turned on according to a first scan signal Gn transferred through the first scan line GL and may perform a switching operation of transferring a data signal DATA transferred through the data line DL to the first node N1.

The third transistor T3 (a compensation transistor) includes a gate terminal, a first terminal, and a second terminal, the gate terminal being connected to the first scan line GL, the first terminal being connected to the second node N2 (or the gate terminal of the first transistor), and the second terminal being connected to the third node N3 (or the second terminal of the first transistor T1). The third transistor T3 may be turned on according to a first scan signal Gn transferred through the first scan line GL to diode-connect the first transistor T1 and may compensate for a threshold voltage of the first transistor T1. The third transistor T3 may have a structure in which two or more transistors are connected in series.

The fourth transistor T4 (a first initialization transistor) includes a gate terminal, a first terminal, and a second terminal, the gate terminal being connected to the second scan line GL−1, the first terminal being connected to the initialization voltage line VL, and the second terminal being connected to the second node N2. The fourth transistor T4 may be turned on according to a second scan signal Gn−1 transferred through the second scan line GL−1 to initialize a gate voltage of the first transistor T1 by transferring the initialization voltage Vint to the gate terminal of the first transistor T1. The fourth transistor T4 may have a structure in which two or more transistors are connected in series.

The fifth transistor T5 (a first emission control transistor) includes a gate terminal, a first terminal, and a second terminal, the gate terminal being connected to the emission control line EL, the first terminal being connected to the driving voltage line PL, and the second terminal being connected to the first node N1. The sixth transistor T6 (a second emission control transistor) includes a gate terminal, a first terminal, and a second terminal, the gate terminal being connected to the emission control line EL, the first terminal being connected to the third node N3, and the second terminal being connected to a pixel electrode of the organic light-emitting diode OLED. The fifth transistor T5 and the sixth transistor T6 are simultaneously turned on according to an emission control signal En transferred through the emission control line EL, and a current flows through the organic light-emitting diode OLED.

The seventh transistor T7 (a second initialization transistor) includes a gate terminal, a first terminal, and a second terminal, the gate terminal being connected to the third scan line GL+1, the first terminal being connected to the second terminal of the sixth transistor T6 and the pixel electrode of the organic light-emitting diode OLED, and the second terminal being connected to the initialization voltage line VL. The seventh transistor T7 may be turned on according to a third scan signal Gn+1 transferred through the third scan line GL+1 and may initialize the voltage of the pixel electrode of the organic light-emitting diode OLED by transferring the initialization voltage Vint to the pixel electrode of the organic light-emitting diode OLED. The seventh transistor T7 may be omitted.

The capacitor Cst includes a first electrode and a second electrode, the first electrode being connected to the second node N2, and the second electrode being connected to the driving voltage line PL.

The organic light-emitting diode OLED may include the pixel electrode and a common electrode facing the pixel electrode. The common electrode may receive the common voltage ELVSS. The organic light-emitting diode OLED may display an image by receiving the driving current from the first transistor T1 and emitting light having a preset color. The common electrode may be provided in common, that is, provided as one body for a plurality of sub-pixels.

Though FIG. 4B illustrates the case where the fourth transistor T4 and the seventh transistor T7 are respectively connected to the second scan line GL−1 and the third scan line GL+1, the embodiment is not limited thereto. In another embodiment, both the fourth transistor T4 and the seventh transistor T7 may be connected to the second scan line GL−1 and driven according to a second scan signal Gn−1.

Though it is illustrated in FIGS. 4A and 4B that transistors of the pixel circuit are P-type transistors, the embodiment is not limited thereto. As an example, transistors of a pixel circuit may be N-type transistors or some of the transistors may be P-type transistors and others may be N-type transistors. Various embodiments may be made.

The pixel circuits of FIGS. 4A and 4B are provided as examples, and a pixel circuit of a pixel P according to an embodiment may be one of known various types of pixel circuits.

Figure 5:
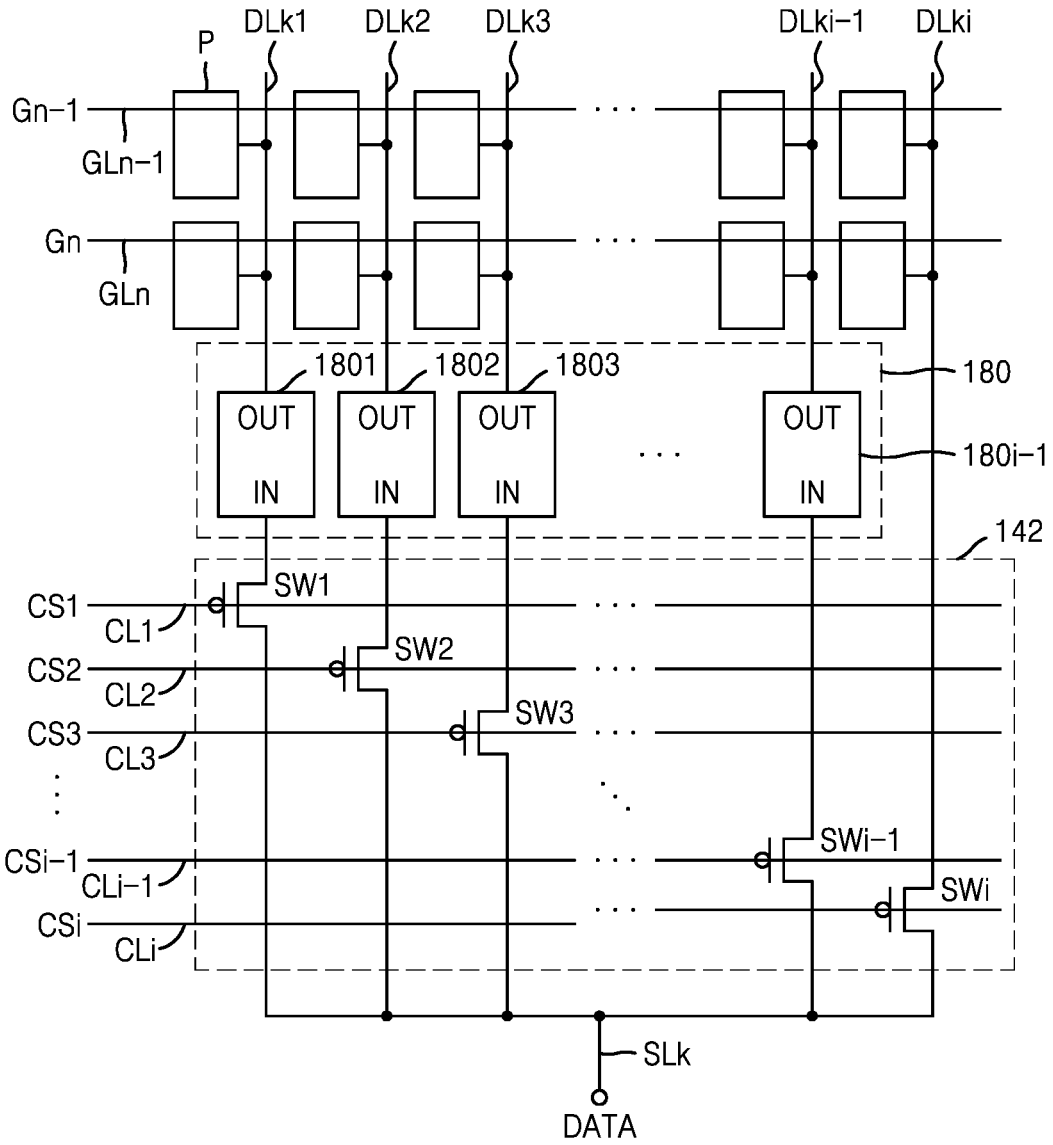
FIG. 5 is a view illustrating a portion of a display panel according to an embodiment.
Figure 6:
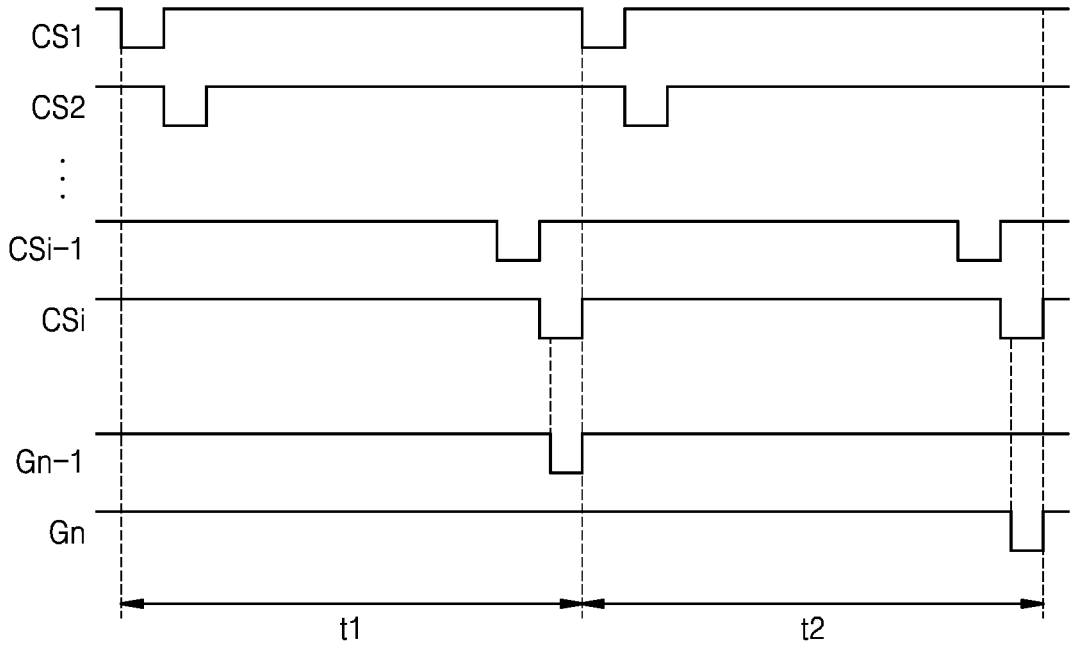
FIG. 6 is a timing diagram illustrating an operation of a demultiplexer illustrated in FIG. 5 according to an embodiment.

FIG. 5 is a view of a portion illustrating a display panel according to an embodiment. FIG. 6 is a timing diagram illustrating an operation of the demultiplexer illustrated in FIG. 5.

FIG. 5 illustrates pixels P connected to a scan line GLn-1 on a (n-1)-th row and a scan line GLn on an n-th row. i data lines ranging from a first data line DLk1 to an i-th data line DLki may be connected to a k-th source output line SLk. The demultiplexer 142 may be arranged between the k-th source output line SLk and the first to i-th data lines DLk1 to DLki. The demultiplexer 142 may include first to i-th switches SW1 to SWi.

The first switch SW1 is arranged between the k-th source output line SLk and the first data line DLk1. The first switch SW1 may include a gate terminal, a first terminal, and a second terminal, the gate terminal being connected to a first control line CL1, the first terminal being connected to the k-th source output line SLk, and the second terminal being connected to the first data line DLk1. The first switch SW1 may be turned on according to a first control signal CS1 applied from the first control line CL1 and may apply a data signal DATA applied to the k-th source output line SLk to the first data line DLk1.

The second switch SW2 may be arranged between the k-th source output line SLk and the second data line DLk2. The second switch SW2 may include a gate terminal, a first terminal, and a second terminal, the gate terminal being connected to a second control line CL2, the first terminal being connected to the k-th source output line SLk, and the second terminal being connected to the second data line DLk2. The second switch SW2 may be turned on according to a second control signal CS2 applied from the second control line CL2 and may apply a data signal DATA applied to the k-th source output line SLk to the second data line DLk2.

The third switch SW3 may be arranged between the k-th source output line SLk and the third data line DLk3. The third switch SW3 may include a gate terminal, a first terminal, and a second terminal, the gate terminal being connected to a third control line CL3, the first terminal being connected to the k-th source output line SLk, and the second terminal being connected to the third data line DLk3. The third switch SW3 may be turned on according to a third control signal CS3 applied from the third control line CL3 and may apply a data signal DATA applied to the k-th source output line SLk to the third data line DLk3.

A data signal applied to each data line may be stored in a parasitic capacitor equivalently formed to the data line. A data signal stored in the parasitic capacitor of the data line may be supplied to a pixel P according to a scan signal.

Because the connection and operation of the fourth switch SW4 to the i-th switch SWi are the same as those of the first to third switches SW1, SW2, and SW3, descriptions thereof are omitted.

The sub-latch portion 180 may be provided between the plurality of pixels and the demultiplexer 142. The sub-latch portion 180 may include a plurality of latches 1801 to 180i-1. The number of switches inside the demultiplexer 142 may be equal to the number of latches inside the sub-latch portion 180. The sub-latch portion 180 may include a plurality of first to (i-1)-th latches 180_1 to 180_i-1 connected to first to (i-1)-th data line DLk1 to DLki-1 except for an i-th data line DLki connected to the source output line SLk at a timing at which a scan signal is applied through scan lines GL1 to GLn among the first to (i-1)-th data lines DLk1 to DLki-1 connected to the demultiplexer 142. As an example, the sub-latch portion 180 may include a plurality of latches connected between the first to (i-1)-th data lines DLk1 to DLki-1 corresponding to the first to (i-1)-th switches SW1 to SWi-1 turned off at a timing at which a scan signal is applied through scan lines among the plurality of first to i-th switches SW1 to SWi inside the demultiplexer.

The sub-latch portion 180 may include the first to (i-1)-th latches 1801 to 180i-1 respectively corresponding to the first to (i-1)-th data lines DLk1 to DLki-1. An input terminal IN of each of the first to (i-1)-th latches 1801 to 180i-1 may be connected to the source output terminal SLk through a corresponding switch of the demultiplexer 142, and an output terminal OUT may be connected to a corresponding data line.

Referring to FIG. 6, the data driver 130 supplies a data signal DATA corresponding to pixels P on a (n-1)-th row during a first period t1 and supplies a data signal DATA corresponding to pixels P on an n-th row during a second period t2. In addition, the controller 150 sequentially supplies first to i-th control signals CS1 to CSi of a switch turn-on voltage.

During the first period t1, a scan signal Gn−1 may be applied to pixels P on a (n-1)-th row, and a data signal DATA stored in the first to i-th data lines DLk1 to DLki may be applied to pixels P on the (n-1)-th row. A scan signal Gn−1 follows an i-th control signal CSi, but an application duration of a scan signal Gn−1 may partially overlap an application duration of an i-th control signal CSi.

During the second period t2, a scan signal Gn may be applied to pixels P on an n-th row, and a data signal DATA stored in the first to i-th data lines DLk1 to DLki may be applied to pixels P on the n-th row. A scan signal Gn follows an i-th control signal CSi but an application duration of a scan signal Gn may partially overlap an application duration of an i-th control signal CSi.

Each of the first to i-th data lines DLk1 to DLki may be floated while a data signal is applied to other data lines. An embodiment may include a latch configured to maintain a constant voltage (e.g. a stored data signal) to each of data lines except for a data line biased at a timing at which a scan signal that writes a data signal on a pixel is applied, that is, each of data lines floated at a timing at which a scan signal that writes a data signal on a pixel is applied among data lines connected to one source output line. A latch may allow each data line to be biased without being floated while a data signal is applied to other data line.

Figure 7:
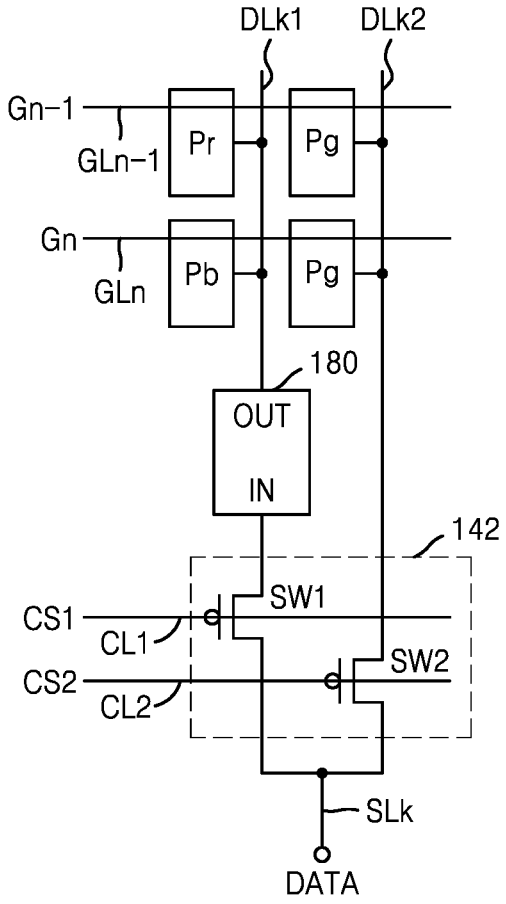
FIG. 7 is a view illustrating an operation of a demultiplexer according to an embodiment.
Figure 8:
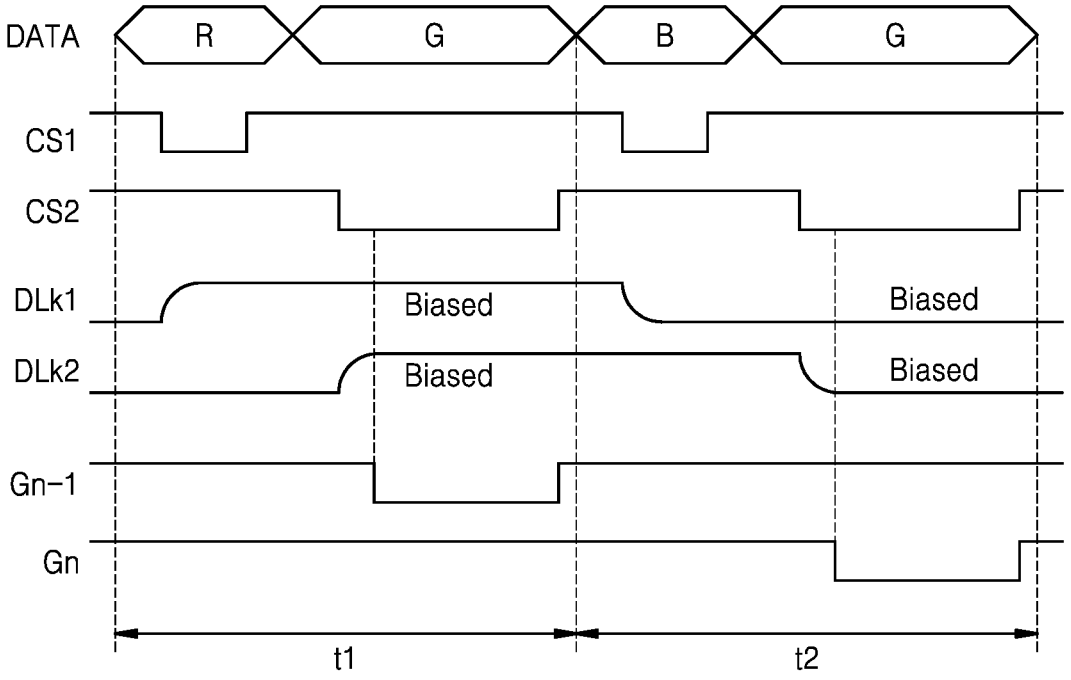
FIG. 8 is a timing diagram for explaining an operation of a demultiplexer illustrated in FIG. 7.
Figure 9:
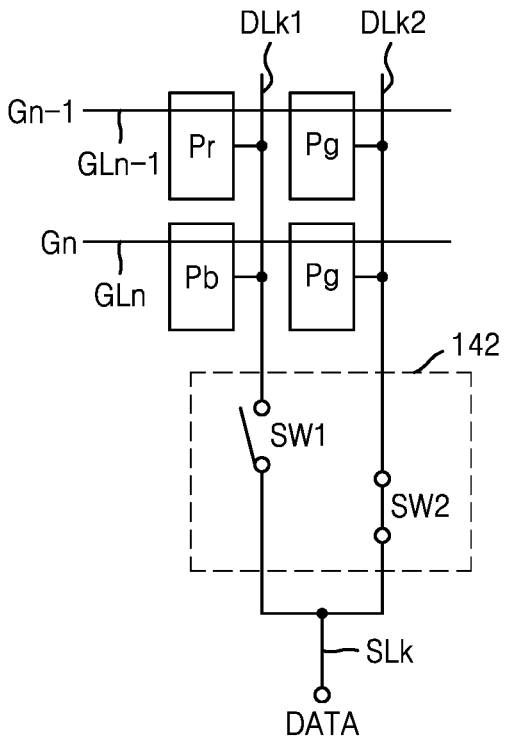
FIG. 9 is a view illustrating an operation of a demultiplexer according to a comparative example.
Figure 10:
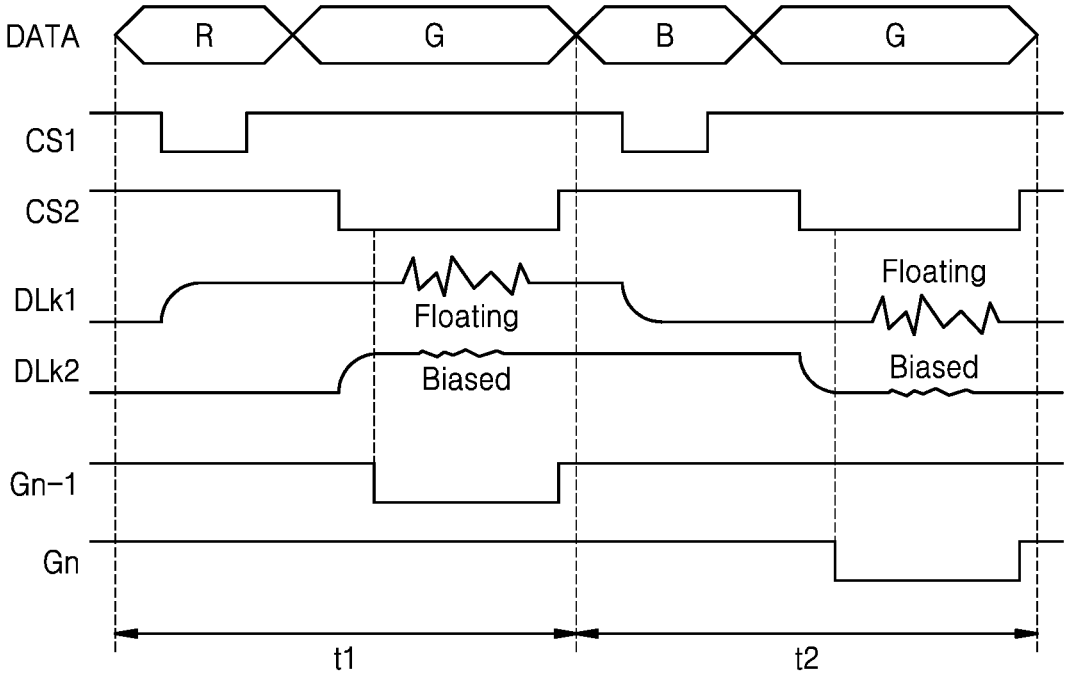
FIG. 10 is a timing diagram illustrating an operation of a demultiplexer illustrated in FIG. 9.

FIG. 7 is a view illustrating an operation of a demultiplexer according to an embodiment. FIG. 8 is a timing diagram illustrating an operation of the demultiplexer illustrated in FIG. 7. FIG. 9 is a view illustrating an operation of a demultiplexer according to a comparative example. FIG. 10 is a timing diagram illustrating an operation of the demultiplexer illustrated in FIG. 9. The comparative example illustrated in FIG. 9 is an example of a display panel in which a latch is not provided between a demultiplexer and a data line.

Hereinafter, for convenience of description, a k-th source output line SLk when i=2, and the demultiplexer 142 connected to the first and second data lines DLk1 and DLk2 are described as examples.

Pixels P may include a first pixel Pr, a second pixel Pb, and a third pixel Pg emitting light of different colors. In an embodiment, a structure may be provided in which a first pixel Pr and a second pixel Pb are alternately arranged on the same column, and third pixels Pg may be arranged in a line on a column neighboring a column on which the first pixel Pr and the second pixel Pb are arranged. The first pixel Pr may be a red pixel emitting red light, the second pixel Pb may be a blue pixel emitting blue light, and the third pixel Pg may be a green pixel emitting green light.

A first control signal CS1 and a second control signal CS2 may be alternately applied at different timings not to overlap each other. The data signal DATA may include a first data signal R applied to a first pixel Pr, a second data signal B applied to a second pixel Pb, and a third data signal G applied to a third pixel Pg.

During the first period t1, the data driver 130 supplies a data signal DATA corresponding to pixels P on a (n-1)-th row. In addition, the controller 150 sequentially supplies first and second control signals CS1 to CS2 of a switch turn-on voltage.

When a first control signal CS1 of a low level is applied, the first switch SW1 is turned on and the second switch SW2 is turned off. The k-th source output line SLk may be connected to the first data line DLk1, and a first data signal R applied to the first data line DLk1 may be stored in the first data line DLk1.

Next, when a second control signal CS2 of a low level is applied, the second switch SW2 is turned on and the first switch SW1 is turned off. The k-th source output line SLk may be connected to the second data line DLk2, and a third data signal G applied to the second data line DLk2 may be stored in the second data line DLk2.

Following a second control signal CS2, a scan signal Gn−1 may be applied to pixels P on a (n-1)-th row, a first data signal R charged in the first data line DLk1 in advance may be applied to the first pixel Pr, and a third data signal G applied to the second data line DLk2 may be applied to the third pixel Pg. A scan signal Gn−1 follows a second control signal CS2 but an application duration of a scan signal Gn−1 may partially overlap an application duration of the second control signal CS2.

As illustrated in the comparative example of FIGS. 9 and 10, while a scan signal Gn−1 is applied, because a third data signal G is applied to the second data line DLk2, the second data line DLk2 is biased, but the first data line DLk1 is floated. Therefore, in the case where an external noise is introduced, a first data signal R of the first data line DLk1 that is floated may be distorted due to an influence of the external noise (e.g. noise, etc. due to the input sensing layer 40 of FIG. 2). Accordingly, when a scan signal Gn−1 is applied, a first data signal R that is distorted may be applied to the first pixel Pr and image quality may be deteriorated.

In contrast, as illustrated in the embodiment of FIGS. 7 and 8, when a first control signal CS1 of a low level is applied from the controller 150, the k-th source output line SLk may be connected to the first data line DLk1, a first data signal R may be applied to an input terminal IN of the latch 180, and an output terminal OUT of the latch 180 may maintain a first data signal R. Accordingly, the first data line DLk1 may store a first data signal R. While a scan signal Gn−1 is applied, because a third data signal G is applied to the second data line DLk2, the second data line DLk2 is biased, and the first data line DLk1 may be biased by the latch 180. Therefore, even though an external noise is introduced, the influence of noise on the first data signal R of the first data line DLk1 may be reduced, and thus, the distortion of the first data signal R may be reduced or prevented.

Likewise, during the second period t2, the data driver 130 supplies a data signal DATA corresponding to pixels P on n-th row. In addition, the controller 150 sequentially supplies a first control signal CS1 and a second control signal CS2 of a switch turn-on voltage.

When a first control signal CS1 of a low level is applied, the first switch SW1 is turned on and the second switch SW2 is turned off. The k-th source output line SLk may be connected to the first data line DLk1, and a second data signal B applied to the first data line DLk1 may be stored in the first data line DLk1.

Next, when a second control signal CS2 of a low level is applied, the second switch SW2 is turned on and the first switch SW1 is turned off. The k-th source output line SLk may be connected to the second data line DLk2, and a third data signal G applied to the second data line DLk2 may be stored in the second data line DLk2.

Following a second control signal CS2, a scan signal Gn may be applied to pixels P on an n-th row, a second data signal B charged in the first data line DLk1 in advance may be applied to a second pixel Pb, and a third data signal G applied to the second data line DLk2 may be applied to a third pixel Pg. A scan signal Gn follows a second control signal CS2 but an application duration of a scan signal Gn may partially overlap an application duration of a second control signal CS2.

As illustrated in the comparative example of FIGS. 9 and 10, while a scan signal Gn is applied, a third data signal G is applied to the second data line DLk2, and thus, the second data line DLk2 is biased, but the first data line DLk1 is floated. Accordingly, in the case where external noise is introduced, a second data signal B of the first data line DLk1 that is floated may be distorted due to the influence of the external noise. Accordingly, when a scan signal Gn is applied, a second data signal B that is distorted may be applied to a second pixel Pb, and thus, image quality may be deteriorated.

In contrast, as illustrated in the embodiment of FIGS. 7 and 8, when a first control signal CS1 of a low level is applied from the controller 150, the k-th source output line SLk may be connected to the first data line DLk1, a second data signal B is applied to an input terminal IN of the latch 180, and an output terminal OUT of the latch 180 may maintain a second data signal B. Accordingly, the first data line DLk1 may store a second data signal B. While a scan signal Gn is applied, a third data signal G is applied to the second data line DLk2, and thus, the second data line DLk2 may be biased, and the first data line DLk1 may be biased by the latch 180. Therefore, even though external noise is introduced, the influence of noise on a second data signal B of the first data line DLk1 may be reduced, and thus, the distortion of the second data signal B may be reduced or prevented.

Figure 11:
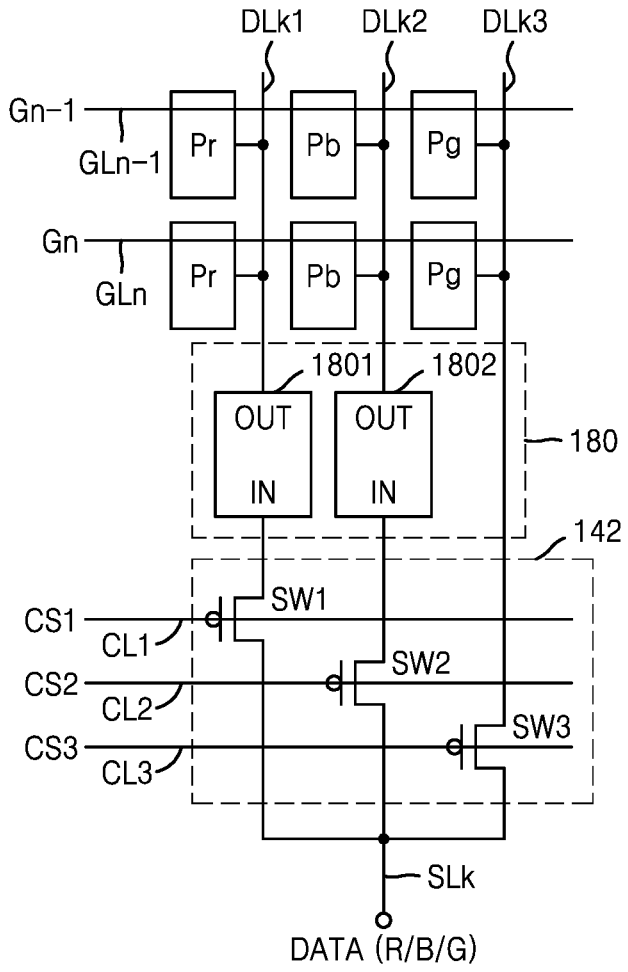
FIGS. 11 and 12 are views illustrating a demultiplexer of a display panel and a portion of the surroundings according to an embodiment.
Figure 12:
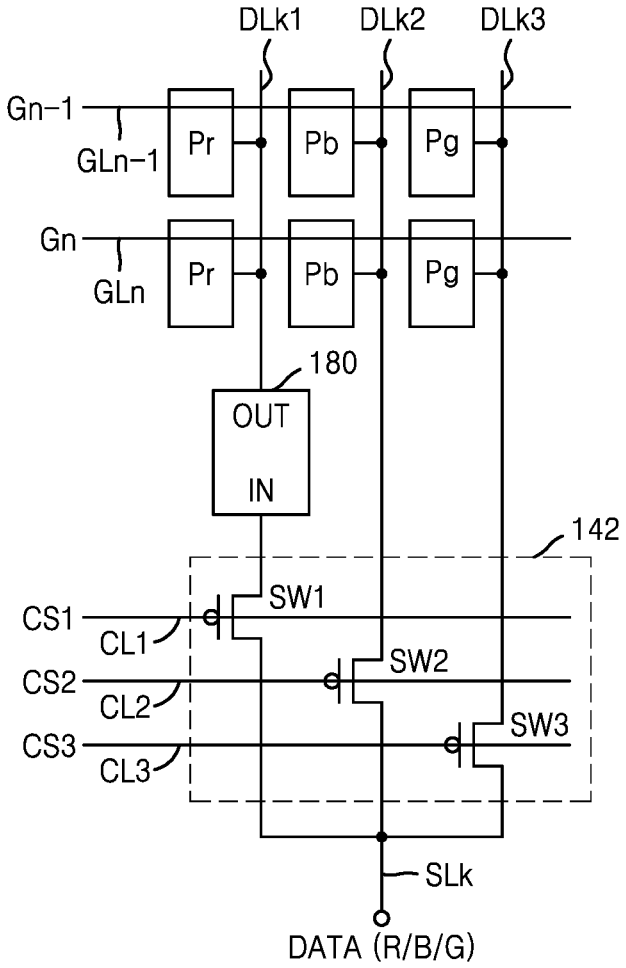

FIGS. 11 and 12 are views illustrating a demultiplexer of a display panel and a portion of the surroundings according to an embodiment.

The embodiment of FIG. 11 illustrates the demultiplexer 142 connected to the k-th source output line SLk and the first to third data lines DLk1, DLk2, and DLk3, and the sub-latch portion 180 in the case where i=3. The demultiplexer 142 includes first to third switches SW1, SW2, and SW3.

In the display area DA, first pixels Pr may be arranged on a first column, second pixels Pb may be arranged on a second column, and third pixels Pg may be arranged on a third column. Columns on which the first pixel Pr, the second pixel Pb, and the third pixel Pg are arranged may be changed depending on the embodiment.

First to third control signals CS1, CS2, and CS3 may be alternately applied at different timings not to overlap each other. As an example, a first control signal CS1, a second control signal CS2, and a third control signal CS3 may be sequentially applied. A first data signal R may be applied to a first pixel Pr, a second data signal B may be applied to a second pixel Pb, and a third data signal G may be applied to a third pixel Pg.

The first switch SW1 may be arranged between the k-th source output line SLk and the first data line DLk1, turned on according to a first control signal CS1 applied from the first control line CL1, and may apply a first data signal R applied through the k-th source output line SLk to the first data line DLk1.

The second switch SW2 may be arranged between the k-th source output line SLk and the second data line DLk2, turned on according to a second control signal CS2 applied from the second control line CL2, and may apply a second data signal B applied through the k-th source output line SLk to the second data line DLk2.

The third switch SW3 may be arranged between the k-th source output line SLk and the third data line DLk3, turned on according to a third control signal CS3 applied from the third control line CL3, and may apply a third data signal G applied through the k-th source output line SLk to the third data line DLk3.

When scan signals Gn−1 and Gn are applied, a third data signal G is applied to the third data line DLk3, and a first data signal R and a second data signal B may be respectively applied to the first data line DLk1 and the second data line DLk2 by latches 1801 and 1802.

The above-described embodiments include latches respectively corresponding to (i-1) data lines that are floated at a timing at which a scan signal is applied among i data lines connected to one source output line, the scan signal writing a data signal on a pixel.

In another embodiment, as illustrated in FIG. 12, a latch may not be connected to a pixel in which visibility of brightness change is low, for example, the second data line DLk2 of a column on which second pixels Pb are arranged. In this case, because a latch is connected to only the first data line DLk1 of a column on which first pixels Pr are arranged, circuit complexity may be reduced without image quality deterioration.

FIGS. 13A, 13B, 13C, and 13D are circuit diagrams illustrating a latch of a latch portion according to an embodiment.

Figure 13A:
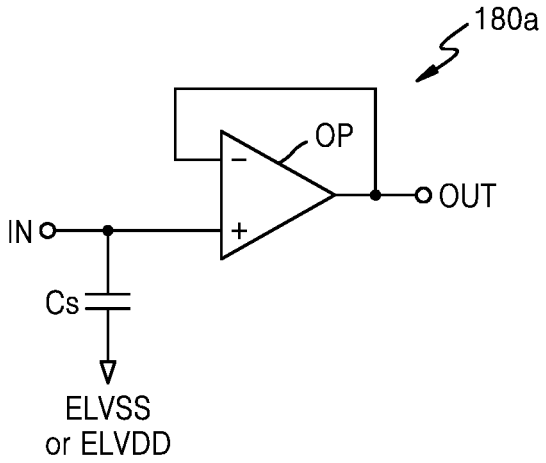
FIGS. 13A, 13B, 13C, and 13D are circuit diagrams illustrating a latch portion according to an embodiment.

Referring to FIG. 13A, each latch of the latch portion 180*a* may include a capacitor Cs and an operational amplifier OP. A first terminal (a (−) terminal or a first input terminal) of the operational amplifier OP may be connected to an output terminal of the operational amplifier OP, and a second terminal (a (+) terminal or a second input terminal) may be connected to the source output line by being connected to an input terminal IN of the latch. An output terminal of the operational amplifier OP may be the output terminal OUT of the latch. The input terminal IN may be connected to the source output line by being connected to one terminal of a switch connected to the source output line. The output terminal OUT may be connected to a data line. The capacitor Cs may be connected between the input terminal IN (the second terminal of the operational amplifier OP) and a power portion. The power portion may supply the driving voltage ELVDD or the common voltage ELVSS. The latch of FIG. 13A illustrates an example in which the operational amplifier OP is implemented as a voltage follower.

Figure 13B:
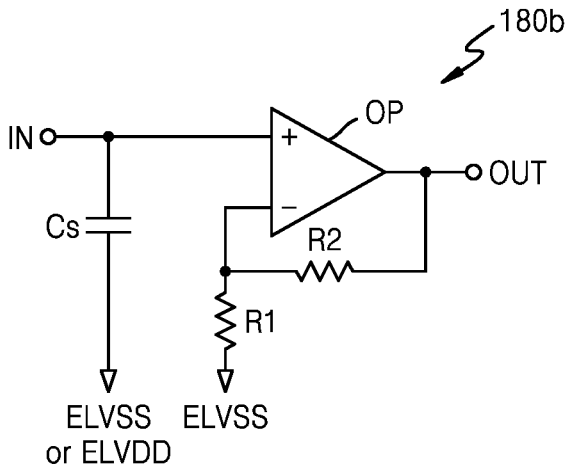

As illustrated in FIG. 13B, each latch of a latch portion 180*b* may include the operational amplifier OP in which a gain thereof is not 1. A resistor R1 and a resistor R2 may be respectively connected between the first terminal (the (−) terminal) of the operational amplifier OP and the power portion and between the first terminal (the (−) terminal) of the operational amplifier OP and the output terminal of the operational amplifier OP (the output terminal OUT of the latch). The power portion connected to the first terminal (the (−) terminal) may supply the common voltage ELVSS.

The embodiments are not limited to the latch portions 180*a* and 180*b* described above and various circuits that may serve as an analog latch may be used.

Figure 13C:
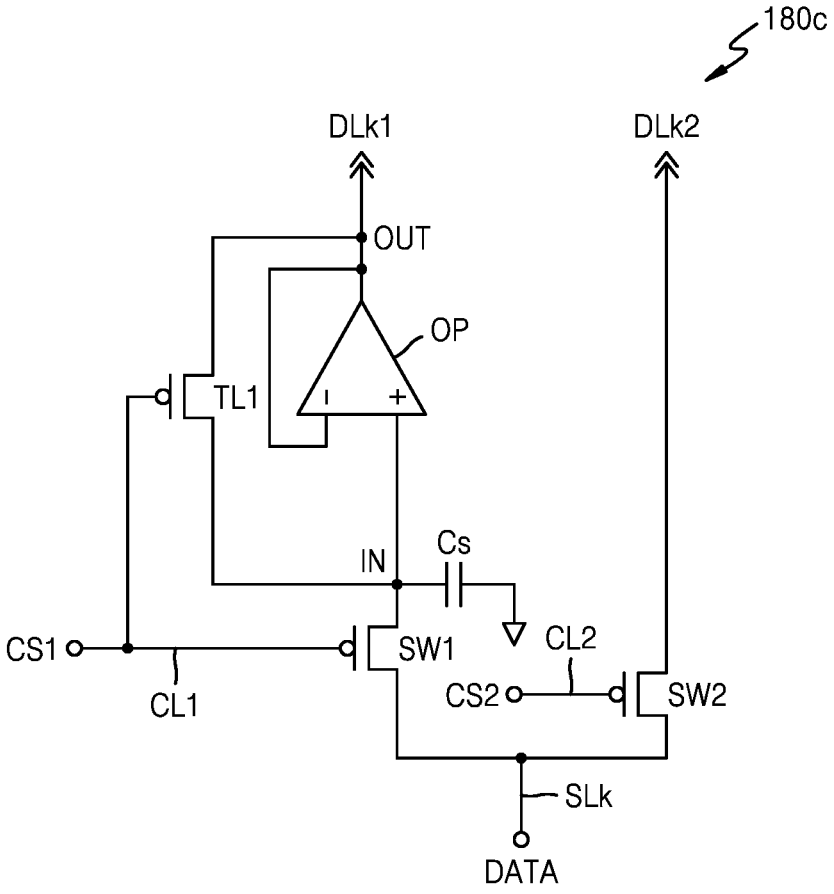
Figure 13D:
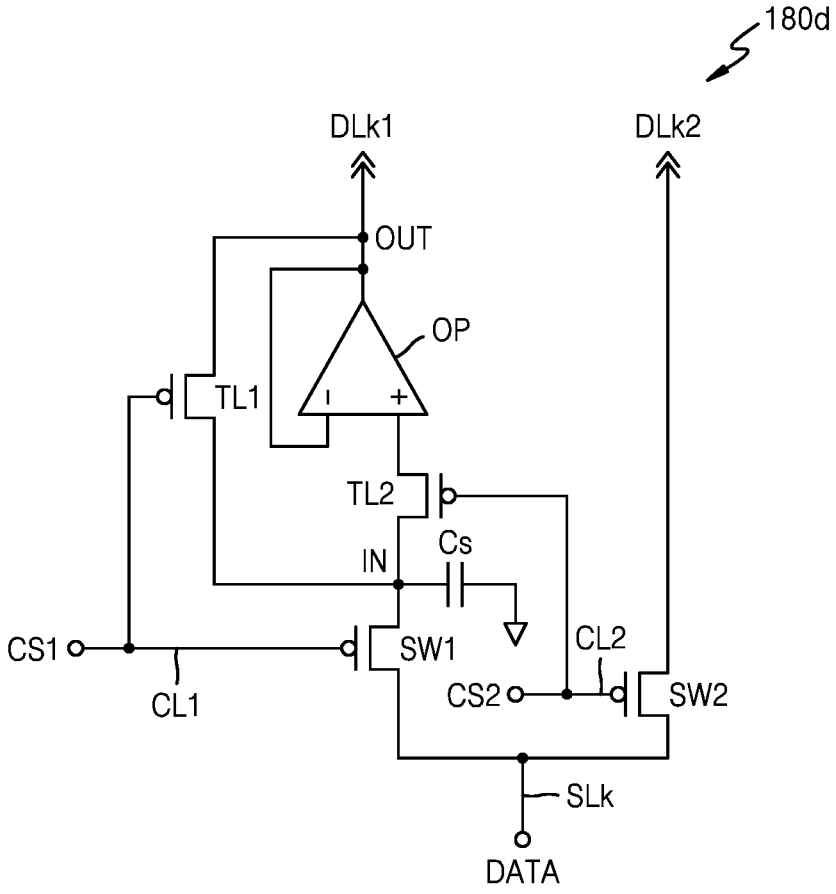

FIGS. 13C and 13D illustrate, as an example, a demultiplexer connected to the k-th source output line SLk and the first and second data lines DLk1 and DLk2, and the latch portion connected to the demultiplexer in the case where i=2. The multiplexer may include a first switch SW1 and a second switch SW2, the first switch SW1 being connected to the k-th source output line SLk and the first data line DLk1, and the second switch SW2 being connected to the k-th source output line SLk and the second data line DLk2. The second switch SW2 may be turned on at a timing at which a scan signal writing data on pixels is applied to connect the source output line to the second data line DLk2. In this case, the latch may be connected between the first data line DLk1 and the first switch SW1. That is, the latch may be connected between the k-th source output line SLk and the first data line DLk1.

Referring to FIG. 13C, each latch of a latch portion 180*c* may be connected to the first data line DLk1 and the first switch SW1 and may include the capacitor Cs and the operational amplifier OP. A first terminal (a (−) terminal or a first input terminal) of the operational amplifier OP may be connected to an output terminal of the operational amplifier OP, and a second terminal (a (+) terminal or a second input terminal) may be connected to the source output line by being connected to an input terminal IN of the latch. An output terminal of the operational amplifier OP may be the output terminal OUT of the latch. The input terminal IN may be connected to the k-th source output line SLk by being connected to one terminal of a first switch SW1 connected to the k-th source output line SLk. The output terminal OUT may be connected to a first data line DLk1. The capacitor Cs may be connected between the input terminal IN (the second terminal of the operational amplifier OP) and a power portion. The power portion may supply the driving voltage ELVDD or the common voltage ELVSS.

The latch portion 180*c* may further include a first latch transistor TL1. The first latch transistor TL1 may be connected between the input terminal IN of the latch (the second terminal of the operational amplifier OP) and the output terminal OUT of the latch (the output terminal of the operational amplifier OP). A gate terminal of the first latch transistor TL1 may be connected to the first control line CL1 connected to a gate terminal of the first switch SW1 and be turned on according to a first control signal CS1. A data signal DATA may be directly applied to the first data line DLk1 through the first latch transistor TL1. The latch portion 180*c* may reduce duration taken for a capacitor of the first data line DLk1 to be charged by charging a capacitor of the first data line DLk1 using the capacitor Cs, the operational amplifier OP, and the first latch transistor TL1. In another embodiment, the gate terminal of the first latch transistor TL1 may be connected to a control line configured to apply a separate control signal.

Referring to FIG. 13D, a latch portion 180*d* may further include a second latch transistor TL2 compared to the latch portion 180*c* illustrated in FIG. 13C. The second latch transistor TL2 may be connected between the second terminal of the operational amplifier OP and the source output line (or the input terminal IN of the latch). A gate terminal of the second latch transistor TL2 may be connected to a second control line CL2 connected to a gate terminal of the second switch SW2 and be turned on according to a second control signal CS2. That is, the second latch transistor TL2 may be turned on at a timing at which a scan signal is applied through scan lines.

While the first latch transistor TL1 applies a data signal DATA to the first data line DLk1, the second latch transistor TL2 is turned off, and thus, the operation of the operational amplifier OP may be blocked. Accordingly, the capacitor of the first data line DLk1 may be charged by only the first latch transistor TL1. The second latch transistor TL2 may be turned on while the capacitor of the second data line DLk2 is charged and may operate the operational amplifier OP, thereby applying a bias to the first data line DLk1. The latch portion 180*d* illustrated in FIG. 13D may reduce power consumption of a display panel compared to the latch portion 180*c* illustrated in FIG. 13C. In another embodiment, a gate terminal of the second latch transistor TL2 may be connected to a control line configured to apply a separate control signal.

FIGS. 13C and 13D illustrate an example including the latch illustrated in FIG. 13A. In another embodiment, the first latch transistor TL1 may be further provided as illustrated in FIG. 13C, or the first latch transistor TL1 and the second latch transistor TL2 may be further provided to the latch illustrated in FIG. 13B as illustrated in FIG. 13D.

Embodiments include a latch in data lines that are floated at a timing at which a scan signal writing data on a pixel is applied and thus the data lines may be biased in a display apparatus including a (n:1)- demultiplexer, wherein switches of the demultiplexer are sequentially turned on to sequentially apply data signals. Accordingly, a voltage corresponding to a data signal charged in a data line may be prevented from being distorted by external noise. That is, according to embodiments, while data signals are sequentially applied to the data lines is connected to the demultiplexer, there is no data line that is floated, and thus, the influence of a data signal due to external noise may be reduced.

According to embodiments, the number of output lines of the data driver is reduced, and thus, manufacturing costs of a display apparatus may be reduced. In addition, according to embodiments, image quality deterioration of a display apparatus due to external noise introduced through a data line may be reduced. However, the disclosure is not limited by such an effect.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. A method for driving a display apparatus, the method comprising:

sequentially receiving a first to a nth control signals and selectively connecting a source output line to n data lines, in response to the first to the nth control signals, n being a positive integer greater than or equal to two; and providing data signals to the source output line;

wherein the data signals provided to the n data lines through the source output line are provided to a plurality of pixels connected to a scan line, in response to a scan signal provided to the scan line and overlapping the nth control signal, and wherein, when the nth data line is biased by the nth control signal connecting the source output line to the nth data line, the first to the n-1th data lines are biased by each of n-1 latches connected to a corresponding one of the first to the n-1th data lines.

2. The method of claim 1, wherein each of the n-1 latches includes:

an amplifier including an input terminal connected to the source output line and an output terminal connected to a corresponding data line from among first to the n-1th data lines; and a capacitor connected between the input terminal and a power portion.

3. The method of claim 2, wherein the power portion applies a first power voltage and a second power voltage to each of the plurality of pixels.

4. The method of claim 2, wherein a first input terminal of the amplifier is connected to the source output line, and a second input terminal of the amplifier is connected to the output terminal.

5. The method of claim 4, wherein each of the n-1 latches further includes:

a first resistor between the second input terminal of the amplifier and the power portion; and a second resistor between the second input terminal and the output terminal.

6. The method of claim 4, wherein each of the n-1 latches further includes a first transistor connected between the first input terminal and the output terminal of the amplifier.

7. The method of claim 6, wherein the first transistor is turned on at a timing at which the corresponding data line is connected to the source output line.

8. The method of claim 6, wherein each of the n-1 latches further includes a second transistor connected between the first input terminal of the amplifier and the source output line.

9. The method of claim 8, wherein the first transistor is turned on at a timing at which the corresponding data line is connected to the source output line, and the second transistor is turned on at a timing at which the scan signal is provided to the scan line.

10. The method of claim 1, wherein each of the first to the nth control signals is provided to a corresponding one of n switches, the n switches being connected between a corresponding data line from among the n data lines and the source output line.

11. An electronic device comprising driving circuits, wherein the driving circuits comprise:

a first driving circuit configured to transmit data signals to a source output line;

a second driving circuit configured to selectively connect the source output line to n data lines, in response to a first to a nth control signal sequentially provided, n being a positive integer greater than or equal to two; and wherein the data signals provided to the n data lines through the source output line are provided to a plurality of pixels connected to a scan line, in response to a scan signal provided to the scan line and overlapping the nth control signal, and wherein, when the nth data line is biased by the nth control signal connecting the source output line to the nth data line, the first to the n-1th data lines are biased by each of n-1 latches connected to a corresponding one of the first to the n-1th data lines.

12. The electronic device of claim 11, wherein the n-1 latches are connected between the second driving circuit and the n-1th data lines, and wherein each of the n-1 latches includes:

an amplifier including an input terminal connected to the source output line and an output terminal connected to a corresponding data line from among first to the n-1th data lines; and a capacitor connected between the input terminal and a power portion.

13. The electronic device of claim 12, wherein the power portion applies a first power voltage and a second power voltage to each of the plurality of pixels.

14. The electronic device of claim 12, wherein a first input terminal of the amplifier is connected to the source output line, and a second input terminal of the amplifier is connected to the output terminal.

15. The electronic device of claim 14, wherein each of the n-1 latches further includes:

a first resistor between the second input terminal of the amplifier and the power portion; and a second resistor between the second input terminal and the output terminal.

16. The electronic device of claim 14, wherein each of the n-1 latches further includes a first transistor connected between the first input terminal and the output terminal of the amplifier.

17. The electronic device of claim 16, wherein the first transistor is turned on at a timing at which the corresponding data line is connected to the source output line.

18. The electronic device of claim 16, wherein each of the n-1 latches further includes a second transistor connected between the first input terminal of the amplifier and the source output line.

19. The electronic device of claim 18, wherein the first transistor is turned on at a timing at which the corresponding data line is connected to the source output line, and the second transistor is turned on at a timing at which the scan signal is provided to the scan line.

20. The electronic device of claim 11, wherein the second driving circuit comprises n switches, the n switches being connected between a corresponding data line from among the n data lines and the source output line, and wherein each of the first to the nth control signals is provided to a corresponding one of n switches.

* * * * *